United States Patent [19]

Derbyshire et al.

[11] 4,395,324

[45] Jul. 26, 1983

[54] THERMAL CRACKING WITH HYDROGEN DONOR DILUENT

[75] Inventors: Francis J. Derbyshire, Ewing; Philip Varghese, Trenton; Darrell D. Whitehurst, Titusville, all of N.J.

[73] Assignee: Mobil Oil Corporation, New York, N.Y.

[21] Appl. No.: 317,036

[22] Filed: Nov. 2, 1981

[51] Int. Cl.[3] ..... C10G 47/34

[52] U.S. Cl. ..... 208/56; 208/107

[58] Field of Search ..... 208/56, 107

[56] References Cited

U.S. PATENT DOCUMENTS 2,053,485 9/1936 Lindeke et al. ..... 208/56
3,238,118 3/1966 Arey et al. ..... 208/59
4,090,947 5/1978 Satchell ..... 208/56

FOREIGN PATENT DOCUMENTS 760546 10/1956 United Kingdom ..... 208/56
1335283 10/1971 United Kingdom ..... 208/251 H

*Primary Examiner*—Delbert E. Gantz
*Assistant Examiner*—Anthony McFarlane
*Attorney, Agent, or Firm*—C. A. Huggett; M. G. Gilman; L. G. Wise

[57] ABSTRACT

An improved hydrogen donor for hydrogen donor diluent cracking is provided by extraction with naphtha from the cracked product and hydrogenation by hydrogen transfer from a lower boiling hydrogen donor such as tetralin.

13 Claims, 1 Drawing Figure

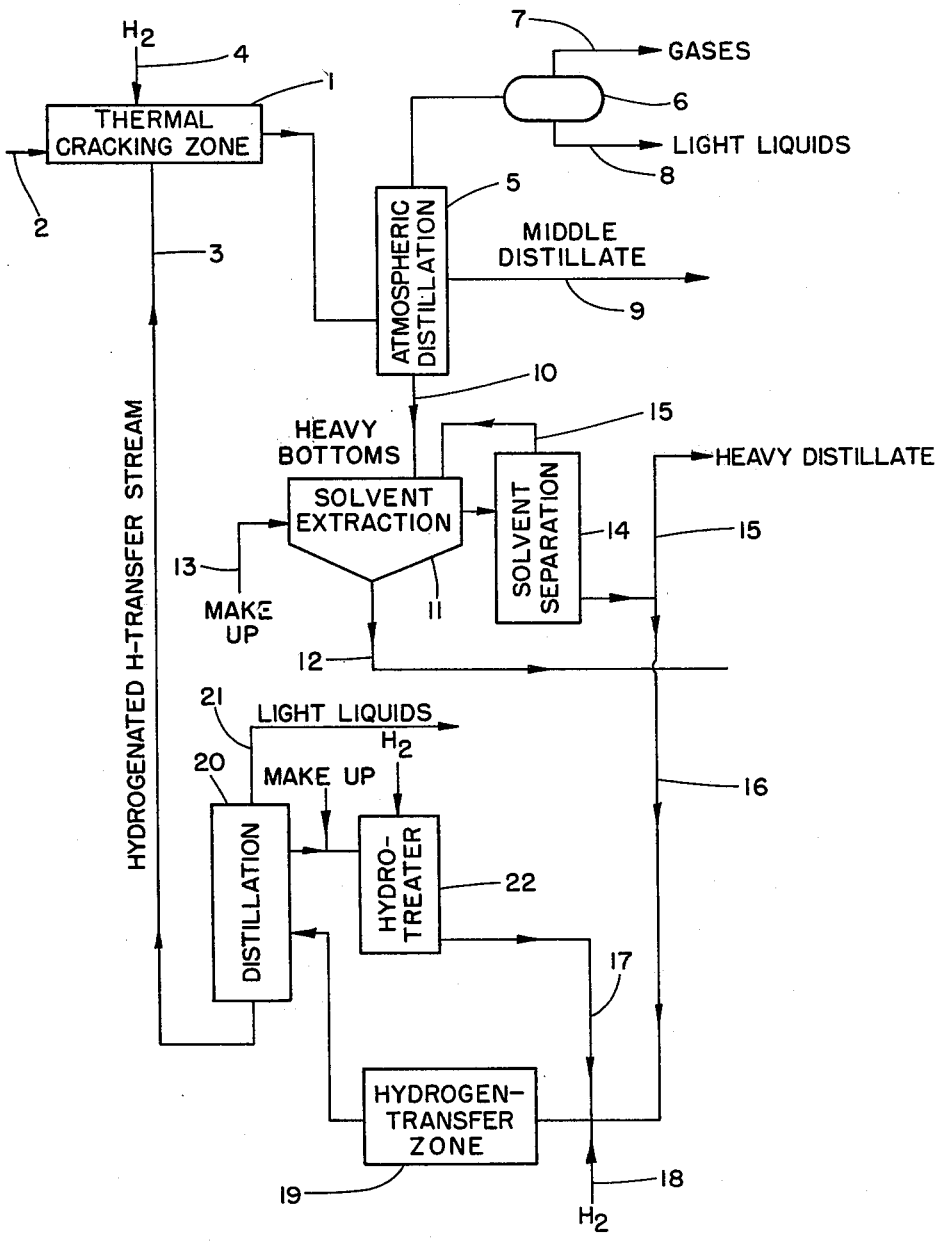
H2
4
THERMAL CRACKING ZONE
1
2
3
7
GASES
6
LIGHT LIQUIDS
8
5
ATMOSPHERIC DISTILLATION
MIDDLE DISTILLATE
9
10
HEAVY BOTTOMS
15
HEAVY DISTILLATE
SOLVENT EXTRACTION
SOLVENT SEPARATION
14
15
13
MAKE UP
11
12
HYDROGENATED H-TRANSFER STREAM
21
LIGHT LIQUIDS
H2
20
MAKE UP
16
DISTILLATION
HYDRO-TREATER
22
17
HYDROGEN-TRANSFER ZONE
19
18
H2

THERMAL CRACKING WITH HYDROGEN DONOR DILUENT

FIELD OF THE INVENTION

This invention is concerned with an improvement in hydrogen donor diluent cracking (HDDC) which is characterized in general by cracking in the substantial absence of added cracking catalyst and under hydrogen pressure, of high boiling hydrocarbon stocks diluted by a hydrocarbon liquid which contains a significant proportion of polycyclic aromatic compounds capable of functioning as hydrogen donors. Typical hydrogen donors are tetralin from hydrogenation of naphthalene, alkyl substituted tetralins, hydrogenated anthracenes, phenanthrenes, pyrenes and the hydrogenated derivatives of other condensed ring aromatics. In such processes, the hydrogen donor functions to supply hydrogen to thermally cracked hydrocarbon fragments to thereby reduce coke formation and provide a superior cracked product.

BACKGROUND OF THE INVENTION

The effect of hydrogen donors in thermal cracking (non-catalytic cracking) of heavy stocks is well understood and various sources of hydrogen donors have been described. In U.S. Pat. No. 3,238,118, the hydrogen donor for thermal cracking of crude still bottoms is the fraction of hydrocracker product boiling above the naphtha range, that is, higher boiling than 430° F. That fraction will contain the polycyclic aromatics and hydrogenated polycyclics generated during hydrocracking including naphthalene, tetralin and higher together with other compounds of like boiling range and including compounds having functional groups to the extent these survive the conditions in the hydrocracker.

A later U.S. Pat. No. 4,090,947 describes hydro-treating of heavy gas oils, including heavy gas oil from a premium coker, to generate a hydrogen donor diluent stream which is then blended with fresh charge for thermal cracking. Such prior practices involve a catalytic hydrogenation of a stream which contains all the components normally present in the fraction to be hydrogenated; including nitrogen, metal and sulfur bearing compounds and compounds such as asphaltenes which have a high propensity for formation of coke. The detrimental effect of such components on hydrogenation catalysts is well known in the art of petroleum processing.

SUMMARY OF THE INVENTION

The invention provides an improved process for hydrogen donation and transfer in the upgrading of heavy stocks by utilizing the difference in facility with which polycyclics of different boiling ranges (different number of condensed rings) accept hydrogen and donate hydrogen to other compounds under thermal cracking conditions. In preferred embodiments, streams of classic hydrogen donors such as tetralin are generated by catalytic hydrogenation of a fraction rich in naphthalene. The resultant tetralin stream is used for transfer of hydrogen to heavier condensed ring aromatics such as pyrene, fluoranthene, nitrogen containing heterocyclic compounds, etc. That heavier stream of hydrogen donors is employed as the hydrogen donor in the HDDC process.

BRIEF DESCRIPTION OF THE DRAWING

A typical system for practice of a preferred embodiment of the invention is represented diagrammatically in the single FIGURE of the annexed drawing.

DESCRIPTION OF SPECIFIC EMBODIMENTS

In a preferred embodiment, the invention provides a two-stage hydrogen transfer process for refining oils. A light naphthenic/aromatic hydrocarbon stream is externally hydrogenated to produce a stream having a high transfer capability. This stream is then reacted under hydrogen transfer conditions with a heavy fraction containing polynuclear aromatics such as pyrene and fluoranthene and nitrogen containing compounds such as benzoquinolines compounds which are superior hydrogen transfer agents. Such a fraction is obtained by exraction of the heavy oils. After the first hydrogen transfer, the light product is separated and recycled, while the heavy hydrogen bearing fraction is used to transfer hydrogen to the heavy oil in the heavy oil cracking step. The process simplifies the recovery and rehydrogenation of the light fraction, which, in the single-stage mode of the prior art, is diluted with extraneous cracked product.

Conventional schemes for the upgrading of high boiling feedstocks such as heavy and residual oils in HDDC involve partially hydrogenating a suitable aromatic stream boiling in the range 400°–1000° F. and using this stream as a hydrogen donor source in a thermal cracking process. Generally, the donor stream is hydrogenated externally to the thermal cracking zone over typical commercial hydrogenation catalysts. In an application of such a process an aromatic stream consisting of vacuum gas oils boiling in the range 650°–1000° F. is hydrogenated and then employed in the thermal cracking zone as a donor diluent.

There are clear advantages to a process scheme where a low boiling (350°–650° F.) stream rather than a high boiling (650°–1000° F.) stream is hydrogenated to regenerate spent donors in the thermal cracking effluent. However, one difficulty in using a relatively low boiling donor stream is that, prior to regeneration and recycle, the spent donors must be recovered from the reactor effluent. Those compounds will now be diluted with cracked products in the same boiling range and these will be a mixture of aromatic, paraffinic and olefinic compounds. Since predominantly the naphthenic-aromatic compounds are required for regeneration and recycle, the required separation is difficult to make.

We have shown that certain high boiling compounds such as polynuclear aromatics, e.g. pyrene, fluoranthene and basic nitrogen compounds such as quinoline and benzoquinolines etc., which are constituents of various petroleum refinery streams, can function as hydrogen transfer agents. That is, they are capable of reaction with molecular hydrogen, during a thermal process, to produce a partially hydrogenated product which is a highly active hydrogen donor.

The formation of these hydro-derivatives is catalyzed by mild hydrogenation catalysts and they can also be formed by the transfer of hydrogen from lower boiling and less active donors. For example, by thermal treatment under hydrogen pressure, tetralin will transfer hydrogen to pyrene forming dihydropyrene. The latter is several times more active as a hydrogen donor than tetralin.

These higher boiling hydrogen transfer agents are present in various refinery streams. In streams which contain a mixture of paraffins, asphaltenes and polynuclear aroamtics it is possible to preferentially extract the polynuclear aromatics and basic nitrogen compounds by solvent extraction.

The basic principle of this invention is to use a high boiling hydrogen-donor-diluent stream in the thermal upgrading of heavy hydrocarbon feedstocks. This obviates the problem of selectively removing the spent donors from the distillate products for recycle. The spent donors are removed from the high boiling products (if necessary) by solvent extraction and regenerated by hydrogen transfer from a low boiling donor stream.

A significant advantage of this process lies in the fact that it utilizes a light donor stream, which is much more easily regenerable, to indirectly introduce hydrogen into the thermal cracking process. This light donor material is not a significant product of the thermal cracking of heavy oils and even if it were, would prove difficult to isolate from the much more abundant light paraffinic products of cracking which boil in the same range of temperatures.

The following table compares the increases in dihydropyrene concentration obtained with light donor and $H_2$ pressure as opposed to that obtained by the interaction of $H_2$ gas and pyrene alone.

TABLE I

| Catalyst No Tetralin | Temp °F. present | Pressure psig | Gas | % Dihydropyrene |
|---|---|---|---|---|
| | 1 Hr. reaction time | | | |
| None | 750 | 1000 | $H_2$ | 0.6 |
| None | 750 | 1800 | $H_2$ | 1.8 |
| 8% Iron Pyrite | 750 | 1000 | $H_2$ | 2.5 |
| 10% Mo $O_3$ | 750 | 1800 | $H_2$ | 11.6 |
| With 50 wt. % Tetralin-Pyrene mixture | | | | |
| None | 750 | 1000 | Ar | 5.7 |
| None | 750 | 1000 | $H_2$ | 8.6 |
| None | 800 | 1800 | $H_2$ | 12.9 |
| 10% Pyrites | 800 | 1800 | $H_2$ | 14.6 |
| 10% Mo $O_3$ | 800 | 1800 | $H_2$ | 16.4 |

As shown above even without gaseous hydrogen the presence of tetralin leads to significantly higher dihydropyrene formation than can be obtained even in mildly catalyzed hydrogenation under high hydrogen pressure. At high hydrogen pressure the presence of tetralin leads to high levels of dihydropyrene formation, providing a means to indirectly hydrogenate pyrene without the use of a catalyst. However, the use of a suitable disposable catalyst such as iron pyrites does, as shown, lead to even better dihydropyrene yields.

The flow sheet of the drawing illustrates a preferred arrangement for realization of the object and advantages of the invention. A heavy hydrocarbon charge stock such as whole or topped crude, atmospheric or vacuum residua, heavy coker gas oil, clarified slurry oil, shale oil, tar sand extract, coal liquifaction products or the like is introduced to a thermal cracker 1 by line 2 where it is mixed with a heavy hydrogen donor stream from line 3 and gaseous hydrogen from line 4. Generally such heavy charge stocks contain high proportions of metals and asphaltenic materials, along with sulfur, oxygen and nitrogen containing compounds and include components boiling upwards of 650° F. Conditions in cracker 1 may be between 650° F. and 900° F. at pressures of 200–4000 pounds per square inch and reaction times of 3 to 90 minutes. The resultant product is transferred to a fractionator 5 for distillation at about atmospheric pressure to produce an overhead stream transferred to separator 6 from which are withdrawn a gaseous stream by line 7 and a light liquid stream boiling up to about 400° F. by line 8.

Fractionator 5 also separates a middle distillate fraction boiling below 600°–700° F., withdrawn by line 9. The remaining bottoms fraction from fractionator 5 contains high proportions of polycondensed aromatics, unconverted heavy oils or residue, coke and ash and passes by line 10 to a solvent extraction stage 11. In solvent extractor 11, the high boiling polyaromatics are extracted by a solvent and later converted to hydrogen transfer agents. The solvent employed in extractor 11 may be derived in the process or provided from external sources.

The solvent applied in extractor 11 to reject coke, ash and a high metals asphaltenic fraction as raffinate in line 2 will typically have a naphtha boiling range and contain 10–50% aromatics by weight. The percent of aromatics may be chosen to vary the depth of extraction. The extraction may be carried out at any convenient temperature and pressure which maintains the solvent in liquid state, including supercritical conditions with respect to the solvent.

The function of rejecting highly functional components of the high boiling gas oil together with asphaltenes, ash and unconverted residues is well served by any hydrocarbon naphtha boiling in the range of about 85°–430° F. and containing 10–50 wt.% of aromatics. Preferably, the naphtha is of relatively narrow boiling range encompassing about 170° to 250° on the Fahrenheit scale. Initial boiling points of suitable naphthas will range from 85° to 200° F., preferably about 100°–200° F. End points are preferably above about 240° F.

Examples of suitable naphtha extraction solvents are crude untreated petroleum naphtha, coker naphtha from the pyrolysis of tar sands, cracked naphthas (e.g., cracked petroleum naphthas produced in FCC operations) and hydro-treated naphthas. Moreover, a suitable naphtha extraction solvent may be obtained by blending paraffins, naphthenes, olefins, and aromatics. The necessary qualities of the solvent are that it have a boiling range and aromatics content meeting the above-described criteria.

The material rejected by the solvent in line 12 may be stripped of entrained naphtha and used as fuel or other suitable purposes, e.g. gasification.

Additional naphtha for make-up may be added at line 13. Additional streams containing high boiling polycyclic compounds may be also added to the feed for extractor 11, e.g., clarified slurry oil from catalytic cracking. The extract phase of naphtha solvent and extract from the high boiling feed stream is flashed or stripped in a separation stage 14 from which naphtha solvent is taken overhead by line 15 for recycle to extractor 11. The stripped extract is constituted by hydrocarbons boiling above 600°–700° F. and containing the polycyclic aromatics and nitrogen heterocycles of fourteen or more carbon atoms from the bottoms of fractionator 5. Those aromatics, including pyrene, fluoranthene, anthracene, benzanthracene, dibenzanthracene, perylene, coronene and lower alkyl analogs are found to be particularly effective for generation of highly effective hydrogen transfer agents. Also effective are basic nitrogen containing compounds such as benzoquinolines.

A portion of the stripped extract from separator 14 may be taken as heavy fuel at line 15. The balance in an amount adequate for the purpose is hydrogenated and returned to the thermal cracker 1 as the hydrogen donor used in the process. Hydrogenation of the recycled hydrogen transfer agents may be conducted by conventional catalytic hydrogenation of the recycle stream from line 16 by a reactor not shown and direct return to cracker 1.

In preferred embodiments, hydrogen donors are generated from the high boiling aromatics by hydrogen transfer from lighter hydrogen donors such as tetralin, alkyl tetralins and the like. The recycle stream from line 16 is mixed with light hydrogen donors from line 17 and hydrogen from line 18 and reacted in hydrogen transfer reactor 19 where the recycled hydrogen transfer stream is hydrogenated by means of hydrogen exchange between it and a hydrogenated lighter aromatic stream containing high concentrations of classical donors such as tetralin and 9-10-dihydrophenanthrene.

This lower boiling donor stream is continuously separated from the effluent of the transfer reactor 19 by distillation and its donor content replenished by a mild hydrogenation step over conventional hydrotreating catalyst. One may also use disposable catalysts in the transfer zone to facilitate and increase the concentration of hydrogenated transfer agents in the resultant product. Manganese modules are exemplary of low cost hydrogenation catalysts which are economically discarded from the system when activity declines instead of regenerating for further use. Losses from the donor stream are expected to be minimal given its easy separability by way of boiling range from the higher boiling stream. Make up of losses in the donor stream can be accomplished from refinery streams such as light cycle stock. The transfer zone 19 operates under temperatures of 300°–480° C. and $H_2$ pressure ranging from 200–4000 psig.

In general, the lighter hydrogen donors will boil below about 600° F., preferably below 550° F.

The effluent of hydrogen transfer reactor 19 is supplied to fractionator 20 from which light liquids are taken overhead at line 21 and the heavy hydrogen donor recycle stream is taken as bottoms, for example, by line 3. The light polycyclic aromatic stream of naphthalene and the like is taken as an intermediate cut and transferred to hydrotreater 22 where tetralin and other light hydrogen donors are generated by catalytic hydrogenation.

The conditions maintained in hydrotreater 22 include temperatures which normally range from about 650° F. to about 850° F., preferably from about 700° F. to about 800° F., and pressures which suitably range from about 650 psia to about 2000 psia, preferably from about 1000 psia to about 1500 psia. The hydrogen treat rate ranges generally from about 600 to about 10,000 SCF/B, preferably from about 1000 to about 5000 SCF/B. Hydrotreater operation is conventional: it is operated under conditions optimized for the production of hydrogen donors, those conditions being known to one skilled in the art.

The hydrogenation catalysts employed are conventional. Typically, such catalysts comprise an alumina or silica-alumina support carrying one or more Group VIII non-noble, or iron group metals, and one or more Group VI-B metals of the Periodic Table. In particular, combinations of one or more Group VI-B metal oxides or sulfides are preferred. Typical catalyst metal combinations include oxides and/or sulfides of cobalt-molybdenum, nickel-molybdenum, nickel-tungsten, nickel-molybdenum-tungsten, cobalt-nickel-molybdenum and the like. A suitable cobalt-molybdenum catalyst is one comprising from about 1 to about 10 weight percent cobalt oxide and from about 5 to about 40 weight percent molybdenum oxide, especially about 2 to 5 weight percent cobalt and about 10 to 30 weight percent molybdenum. Methods for the preparation of these catalysts are well known in the art. The active metals can be added to the support or carrier, typically alumina, by impregnation from aqueous solutions followed by drying, calcining and sulfiding to activate the composition. Suitable carriers include, for example, activated alumina, activated alumina-silica, zirconia, titania, etc., and mixtures thereof. Activated clays such as bauxite, bentonite and montmorillonite, can also be employed.

The process of this invention exploits two attributes of donor-diluents recycled to thermal cracking processes. First, that low boiling classical donors (e.g. tetralin) can transfer significant amounts of hydrogen to hydrogen transfer agents, thus enhancing the concentration of the very active donor analogs (e.g. dihydropyrene) within the hydrogen transfer stream. Second, that suitable streams of hydrogen transfer agents can be isolated from the products of the thermal cracking by a flexible solvent extraction step that can follow an atmospheric distillation.

Taken together the characteristics noted above show the prospect for process improvements because of the following. (a) Process improvements result because an atmospheric distillation will suffice to remove lower boiling distillate products of thermal cracking by leaving behind the higher boiling hydrogen transfer agents for eventual recycle. (b) Generation of a hydrogen enriched hydrogen transfer stream is accomplished without the need to hydrotreat a heavy hydrogen transfer stream, with the consequent catalyst cost, and (c) the process scheme outlined conserves the lighter aromatics stream of classical donors which are not generated in significant quantities in a thermal cracking process for heavy oils and avoids their dilution by paraffinic and olefinic products that are formed during thermal cracking and boil within the same range of temperatures.

The process scheme outlined can be used to overcome some of the drawbacks in previously proposed hydrogen-diluent-cracking schemes.

Specifically:

(a) it avoids the need to hydrotreat a heavy-donor diluent with its attendant catalyst requirements in order to regenerate spent donors. (b) only a lighter boiling donor stream is hydrotreated and used as a medium for the production of hydroaromatics in the heavy recycle stream, and (c) it conserves the lighter hydrogen donor stream by using it in a loop external to the thermal cracking zone, thus avoiding its dilution by thermal cracking products.

What we claim is:

1. In a process for hydrogen donor diluent cracking of heavy hydrocarbon charge stock by mixing said charge stock with a hydrogen donor stream containing hydrogenated condensed ring aromatic compounds and reacting the mixture at thermal cracking conditions under hydrogen pressure, the improvement which comprises separating from the product of said hydrogen donor diluent cracking a fraction boiling above about 600° F., separating a heavy aromatic portion from said fraction by extraction with a hydrocarbon naphtha containing 10 to 50 percent by weight of aromatic compounds, hydrogenating said heavy aromatic portion by reacting the same with lower boiling hydrogenated condensed ring aromatic compounds under hydrogen transfer conditions, separating said lower boiling condensed ring aromatic compounds from the hydrogenated heavy aromatic portion resulting from the reaction to generate hydrogen donors from condensed ring aromatic compounds therein, and recycling the hydrogenated heavy aromatic portion to provide said hydrogen donor stream.

2. A process according to claim 1 wherein the fraction so separated from the cracking product boils above about 700° F.

3. A process according to claim 1 wherein said naphtha is a mixture of hydrocarbons boiling between about 85° F. and about 430° F.

4. A process according to claim 1 wherein said lower boiling condensed ring aromatic compounds have boiling points below about 600° F.

5. A process according to claim 1 wherein said lower boiling condensed ring aromatic compounds are naphthalene and alkyl naphthalenes.

6. A process according to claim 1 wherein hydrogenation of heavy aromatic fraction is conducted by contacting said heavy aromatic fraction and hydrogen with a hydrogenation catalyst.

7. A process according to claim 6 wherein said catalyst comprises manganese nodules.

8. An improved hydrogen donor diluent cracking process for hydro-treating heavy hydrocarbon charge stock comprising the steps of (a) contacting the hydrocarbon charge stock in the substantial absence of cracking catalyst with a hydrogen donor containing hydrogenated condensed ring aromatic compounds under hydrogen pressure and thermal cracking conditions at a temperature of about 650° F. to 900° F.;

(b) distilling the cracking product of step (a) to separate a fraction boiling above about 600° F.;

(c) extracting from said fraction a heavy aromatic portion by contacting said fraction with liquid hydrocarbon naphtha containing about 10 percent to 50 percent by weight of aromatic compounds, wherein said naphtha comprises a mixture of hydrocarbon boiling between about 85° F. and 430° F.;

(d) reacting extracted heavy aromatic portion from step (c) with at least one lower boiling hydrogenated condensed ring aromatic compound under hydrogen transfer conditions;

(e) separating hydrogenated heavy aromatic portion from the reaction product of step (d); and (f) recycling hydrogenated heavy aromatic portion from separation step (e) to cracking step (a).

9. The process of claim 8 wherein the heavy aromatic portion in step (d) is reacted with tetralin.

10. The process of claim 8 wherein the extracted heavy aromatic portion from step (c) is stripped of naphtha solvent to provide a polycyclic aromatic portion containing pyrene.

11. In the process for hydrogen donor diluent cracking of heavy hydrocarbons wherein a hydrogen donor stream is reacted with hydrocarbon charge under thermal cracking conditions with hydrogen pressure; the improvement which comprises reacting a heavy polycyclic aromatic stream with a lower boiling hydrogenated condensed ring aromatic stream under hydrogen transfer conditions; fractionating said lower boiling stream from the hydrogenated heavy aromatic stream; and introducing said hydrogenated heavy aromatic stream as a hydrogen donor stream to the hydrocarbon charge.

12. The process of claim 11 wherein the heavy aromatic stream includes pyrene, fluorancororene, anthracene, benzanthracene, dibenzanthracene, perylene, coronene, lower alkyl analogs of said heavy aromatic compounds, or benzoquinolines.

13. The process of claim 12 wherein the lower boiling stream includes tetralin or alkyl tetralins.

* * * * *